US005255060A

United States Patent [19]

Chikano

[11] Patent Number: 5,255,060

[45] Date of Patent: Oct. 19, 1993

[54] FIXING APPARATUS FOR ELECTROGRAPHIC RECORDER

[75] Inventor: Hisao Chikano, Tokyo, Japan

[73] Assignee: Ricoh Company Ltd., Tokyo, Japan

[21] Appl. No.: 903,569

[22] Filed: Jun. 24, 1992

[30] Foreign Application Priority Data

Jun. 28, 1991 [JP] Japan ..... 3-158825

[51] Int. Cl.[5] ..... G03G 15/20

[52] U.S. Cl. ..... 355/290; 219/216

[58] Field of Search ..... 355/282, 285, 289, 290, 355/295; 219/216

[56] References Cited

U.S. PATENT DOCUMENTS

| | | | |
|---|---|---|---|
| 4,192,229 | 3/1980 | Tsunoi et al. | 219/216 X |
| 4,315,682 | 2/1982 | Parzanici | 219/216 X |
| 4,842,944 | 6/1989 | Kuge et al. | 355/285 X |
| 4,853,737 | 8/1989 | Hartley et al. | 355/289 |
| 4,855,763 | 8/1989 | Kan et al. | 346/160.1 |
| 4,935,327 | 6/1990 | Takizawa et al. | 430/110 |
| 4,956,211 | 9/1990 | Saito | 428/36.5 |
| 5,017,970 | 5/1991 | Sakata | 355/290 |

FOREIGN PATENT DOCUMENTS

| | | |
|---|---|---|
| 5826058 | 8/1956 | Japan . |
| 50-62447 | 5/1975 | Japan . |
| 54-143145 | 11/1979 | Japan . |
| 55-29822 | 3/1980 | Japan . |
| 59-66256 | 5/1984 | Japan . |
| 63-274968 | 11/1988 | Japan . |

*Primary Examiner*—Leo P. Picard
*Assistant Examiner*—Christopher Horgan
*Attorney, Agent, or Firm*—Cooper & Dunham

[57] ABSTRACT

A heat roller type fixing apparatus which prevents forming of wrinkles on a material for printing and eliminates a jitter of a picture. The apparatus comprises a single fixing roller equipped with a heater, and two pressing rollers pressed to the fixing roller. The fixing roller and the two pressing rollers are arranged so that a collision angle, an angle in which the printing material ejected from a nip portion of a first pressing roller collides with a second pressing roller, is less than 67 degrees.

9 Claims, 4 Drawing Sheets

FIXING APPARATUS FOR ELECTROGRAPHIC RECORDER

BACKGROUND OF THE INVENTION

The present invention relates to a fixing apparatus for an electrographic recorder and more particularly to a fixing apparatus which fixes a toner to a material to be printed by using a heat roller.

Conventionally, a heat roller fixing apparatus is widely used as a fixing apparatus for an electrographic recorder which employs an electrographic process such as one used in an electrographic copy machine. A laser printer is a typical electrographic recorder.

FIG. 1 is a cross sectional view of a laser printer having a conventional heat roller fixing apparatus. A paper cassette is detachably mounted to a main body 12 of the printer. A sheet of paper 2 fed by a paper supplying apparatus 1 is conveyed with appropriate timing to a latent image carrier, comprising a photoconductor 4 on a drum, by a pair of register rollers 3. The photoconductor 4 is rotated counterclockwise, and during this rotation, the surface of the photoconductor is charged by an electronic charger 5. A laser beam from a laser system 6 is applied to the surface of the photoconductor 4 to an electrostatic latent image to be formed on the photoconductor 4. This latent image is made visual by toner when it passes through a developing apparatus. This visual image is transferred to the paper 2, which has been fed to the photoconductor 4, by a transfer-separation charger 8. The paper 2, which has been adhered to the photoconductor 4, is electrostatically separated from the photoconductor 4 and then conveyed to a fixing apparatus 9. The visual image transferred to the paper 2 is fixed thereon and is then fed to a discharge part. In the meantime, the photoconductor 4, in a state where the transferring of the image is complete, is cleaned by a cleaning apparatus 11 which has a cleaning blade. Toner removed from the photoconductor 4 is collected in the cleaning apparatus 11.

In recent years, materials printed by an electrographic recorder, particularly for a laser printer, have become diversified. Specifically, the demand for printing an image on a layered material such as an envelope has been increasing. Such a material as an envelope does not have a uniform thickness because it comprises a plurality of papers stacked on top of each other, each paper being adhered at its edges to another paper. When such a layered material is supplied to a heat roller fixing apparatus, which apparatus comprises a rigid fixing roller equipped with a heat source and a pressing roller jacketed with an elastic outer layer, wrinkles is usually formed on the layered material. Further, the quality of the picture printed on such a material does not reach a usable level, e.g. bad quality fixing, because the material is too thick.

Measures have been taken to eliminate these problems, such as reducing the hardness of the pressing roller. However, particularly in a high speed recorder, an optimum condition in which no wrinkles are formed, and with a sufficient fixing, has not been obtainable. With the above in mind, a method has been employed in which a plurality of pressing rollers are used to allow a material for printing to contact a fixing roller within a "nip" portion of each roller. The "nip" portion is a portion of the pressing roller deformed along the outer surface of the fixing roller by pressing the pressing roller to the fixing roller. By having a plurality of pressing rollers, a material for printing can be brought into contact with the fixing roller at the "nip" portion of each pressing roller, thus allowing a pressing force of each roller to be decreased. Therefore, forming of wrinkles can be prevented.

The above mentioned method is disclosed in Japanese Laid-open Patent Applications No. 55-29822 and No. 54-143145 and Japanese Laid-open Utility Model Applications No. 58-26058 and 59-66256. However, in a case where a printing material not easily torn, such as an envelope or a thick paper is supplied to a fixing apparatus having a plurality of pressing rollers, the printing material may receive a shock when it collides with a second pressing roller after the printing material is ejected from the "nip" portion formed between a first pressing roller and a fixing roller. Whether such a collision occurs depends upon the angle of motion of the printing material onto the roller. The influence of this collision appears as a "jitter" (a shear in printing) and causes a deterioration of the printing quality.

A method is suggested in Japanese Laid-open Patent Application No. 63-274968 in which speeds of two pressing rollers are respectively controlled. As a result, an appropriate tension force is applied to the material so as to prevent the occurrence of wrinkles. However, this method has a problem in that the fixing apparatus becomes complex due to each pressing roller being independently controlled by a respective power source.

Japanese Laid-open Patent Application No. 50-2447 discloses a construction, as shown in FIG. 2, wherein two pressing rollers, each having a plurality of short rollers, are arranged in such way that the short rollers of each of the two pressing rollers are alternately placed. Pressing rollers are arranged in this way so that a printing material can be easily separated from a fixing roller. In addition it is considered that occurrence of wrinkles can be prevented by allowing a slippage of the paper escaped on the both sides of the pressing roller.

However, there is a problem in that insufficient fixing may occur if a gap is formed between the alternately placed short rollers of each of the pressing rollers. Similarly, an image irregularity may occur in a portion where alternately placed short rollers overlap.

SUMMARY OF THE INVENTION

It is a general object of the present invention to provide a novel and improved fixing apparatus for an electrographic recorder in which the above mentioned problems are eliminated.

A more specific object of the present invention is to provide a fixing apparatus in which no "jitter" occurs, and forming of wrinkles is decreased as compared to previous technology.

The above mentioned objects of the present invention are achieved by a fixing apparatus comprising:

a fixing roller, equipped with a heater for fixing a toner transferred onto a material for printing; and a plurality of pressing rollers, spaced a predetermined distance apart from each other along the outer surface of the fixing roller, each of the pressing rollers being pressed to the fixing roller so as to respectively form a nip portion, a material for printing being caught in the nip portion so that the toner is fixed onto the material, the fixing roller and the plurality of pressing rollers being arranged so that an angle formed between a line tangential to the fixing roller at an outlet point of a nip portion of an upstream pressing roller and a line tangential to a downstream pressing roller at a point where the first tangential line of the nip portion intersects a surface of the pressing roller located at a downstream side along a conveyance line of the material is less than 67 degrees.

According to the present invention, forming of wrinkles can be prevented by a reduction in pressing force of the pressing rollers, and a jitter of the picture is decreased by eliminating the shock generated when the material for printing collides with the pressing roller. Therefore, a fixing apparatus is realized that can obtain a better quality of picture compared to the conventional apparatus.

Other objects, features and advantages of the present invention will become more apparent from the following detailed description when read in conjunction with the accompanying drawings.

DESCRIPTION OF PREFERRED EMBODIMENT

Figure 1:
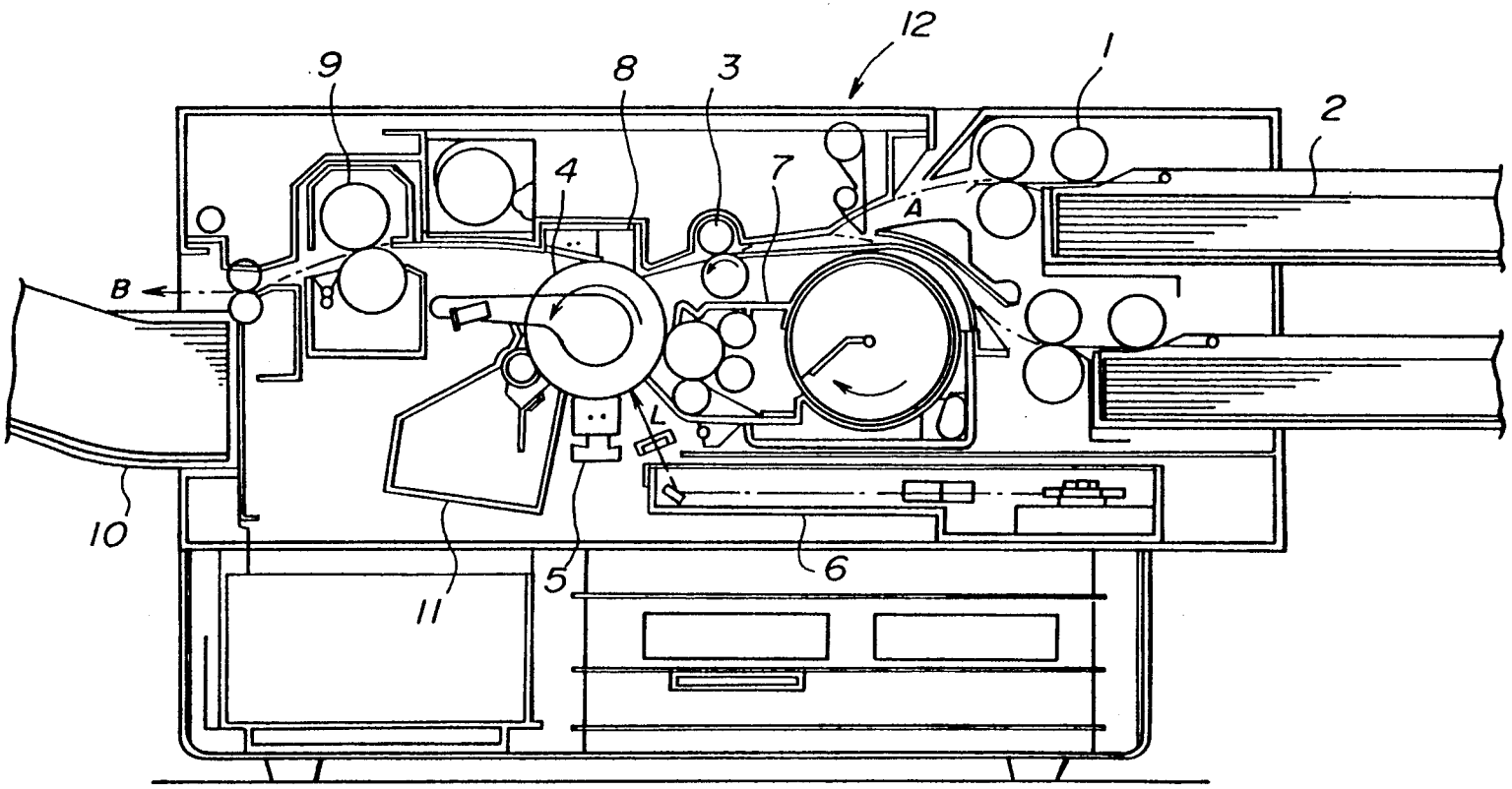
FIG. 1 PRIOR ART
FIG. 1 is a cross sectional view of a laser printer having a conventional heat roller fixing apparatus.
Figure 2:
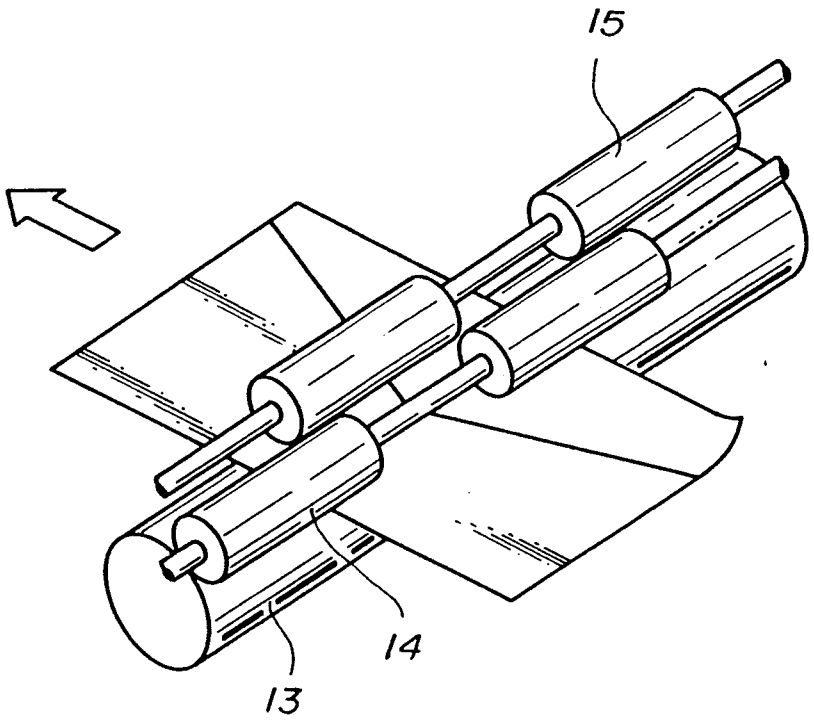
FIG. 2 PRIOR ART
FIG. 2 is a perspective view of an example heat roller fixing apparatus wherein two pressing rollers, each having a plurality of short rollers, are arranged such that each of the short rollers of the two pressing rollers are located alternately.
Figure 3:
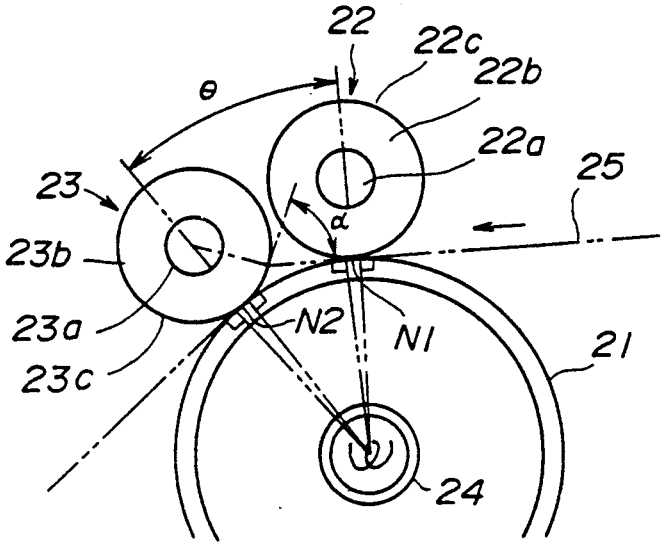
FIG. 3 is a side view of an embodiment of the present invention.

A description will be given of an embodiment of the present invention with reference to FIG. 3. First and second pressing rollers 22 and 23 are pressed to a fixing roller 21, the first and second rollers being spaced apart from each other with angle Γ along an outer surface of the roller 21 and the roller 21 being equipped with a heater. A first nip portion N1 and a second nip portion N2 are formed respectively between the fixing roller 21 and the pressing rollers 22 and 23. A material 25 for printing firstly passes through the first nip portion N1 and then passes through the second nip portion N2. An image transferred onto the material 25 is fixed on the printing material by heat from the fixing roller 21 at and between these nip portions N1, N2.

A top edge of the material 25 ejected from the first nip portion N1 proceeds along a tangential line of the roller 22, at an outlet point of the nip portion N1, due to the rigidity of the material 25, and collides with an outer surface of the pressing roller 23 with a collision angle of α. As shown in FIG. 3, the collision angle α is an angle formed between the tangential line of the roller 22 at an outlet point of the first nip portion and a tangential line of the pressing roller 23 at a point where the tangential line of the first nip portion intersects an outer surface of the pressing roller 23.

Since the roller 23 is pressed to the fixing roller 21 and is rotated according to the fixing roller 21, a paper jam does not occur by this collision. The material 25 is conveyed to the second nip portion N2 where the material 25 is caught between the fixing roller 21 and the pressing roller 23 and is conveyed further.

However, in case the above mentioned collision angle α is too large, the material 25 can not smoothly enter the nip portion N2. In this case, the material 25 collides with a shock and the shock is transmitted to the first nip portion N1 and a transferring part located further along the upstream side. When the shock is transmitted to the transferring part, a "jitter" occurs, and the quality of the picture is deteriorated.

The inventor of the present invention obtained a relationship between collision angle and occurrence rate of a disorder of an irregularity of a picture by conducting an experiment. The experiment was conducted by varying the relative positions of the fixing roller 21 and the pressing rollers 22 and 23 so as to vary the collision angle α. As a material for printing, a regular envelope was used.

Figure 4:
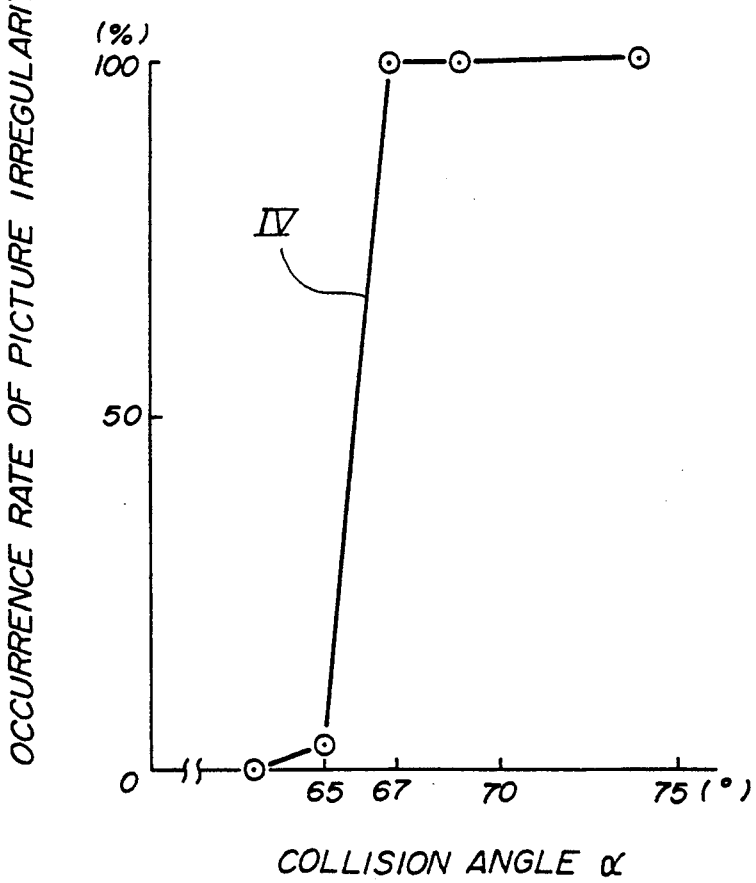
FIG. 4 is a graph showing a relationship between a collision angle and an occurrence rate of an irregularity of a picture.

FIG. 4 is a graph showing results of the above mentioned experiment. A vertical line of the graph represents an occurrence rate of picture irregularities, and a horizontal line of the graph represents a collision angle α.

An shown by the line IV of the graph, an occurrence rate of irregularities remains at approximately zero until the collision angle α becomes 65 degrees. The occurrence rate sharply increases between the collision angles α of 65 degrees and 67 degrees, and reaches a 100% when the collision angle α exceeds 67 degrees. The results of this experiment imply that it is preferable to arrange the positions of the fixing roller 23 and the pressing rollers 22,23 so as to have the collision angle α be less than 67 degrees.

Figure 5:
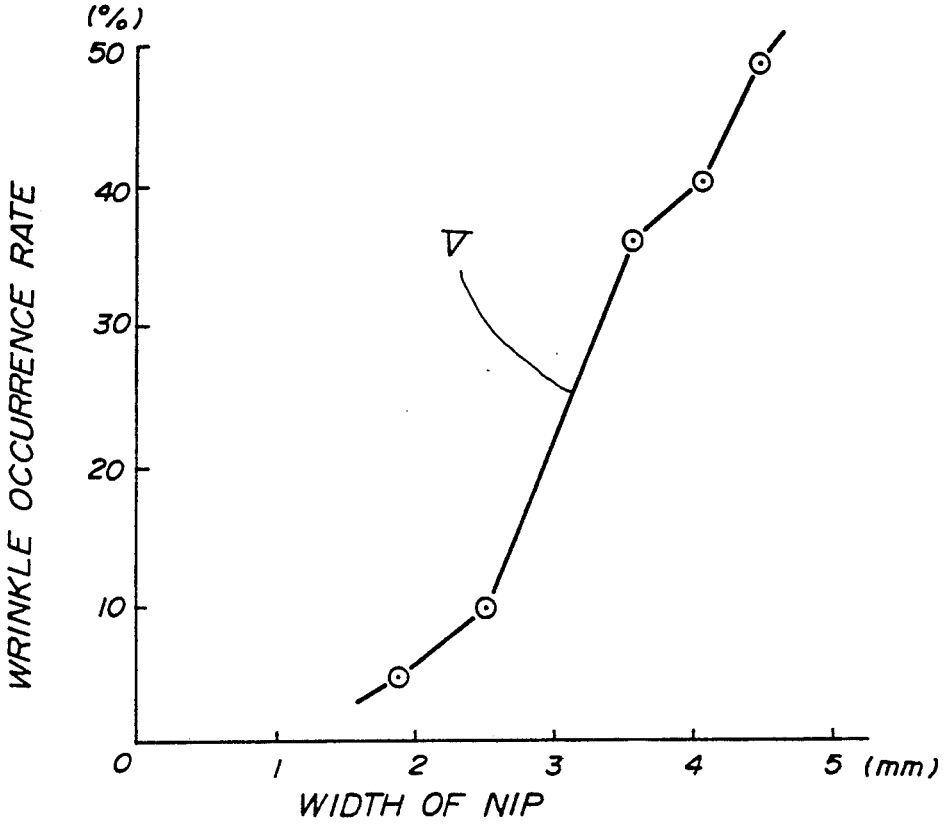
FIG. 5 is a graph showing a relationship between a width of a "nip" and a wrinkle occurrence rate.

Further, it is preferable that a width of a nip is as small as possible for reducing the occurrence of wrinkles, which is a major object of the present invention. An experiment was conducted to investigate the influence of a width of a nip on the occurrence rate of wrinkles. A graph of FIG. 5 shows the results of the experiment. A vertical line of the graph represents an occurrence rate of wrinkles and a horizontal line of the graph represents a nip with.

As shown by the line V of FIG. 5, occurrence of wrinkles sharply increases when the nip width of each roller becomes more than 2.5 mm. If wrinkles are formed on the envelope, the quality of the printing on the envelope is deteriorated.

Following is a discussion regarding whether nip width or a pressing force has a greater effect on forming of wrinkles on an envelope. A wrinkle on an envelope is considered to be formed by a conveyance difference between the front and back face of the envelope.

This conveyance difference is produced by a difference of conveyance speed between the fixing roller and a pressing roller due to a deformation of the pressing roller. Particularly, when a thick paper such as an envelope is caught in a nip, the deformation of a pressing roller becomes larger, which causes a partial slowdown of the circumferential speed of the pressing roller at the nip portion. This partial slowdown results in a decrease of the conveyance speed of the paper contacting with the pressing roller and eventually causes forming of wrinkles. This deformation becomes larger as the width of the nip increases. As mentioned above, although there are other factors such as a construction of the rollers and a hardness of a rubber of the pressing roller, it is considered that an occurrence of wrinkles depends mostly on the nip width.

Diameters of the pressing rollers 22, 23 are determined on the basis of the pressing force and allowable deformation of the pressing rollers, and accordingly, the diameter of the roller base is determined. A diameter of a roller base greater than 8 mm is required even for an A4/Letter size model, which has a minimized size. A diameter of the rollers 22,23 is required to be more than 12 mm since a 2 mm thick elastic layer is to be provided on the outer surface of the roller base.

A diameter of the fixing roller 21 was calculated on the basis of the above mentioned conditions, and it was found that the diameter of the fixing roller 21 needs to be more than 18 mm in order to satisfy the condition in which the collision angle is less than 67 degrees.

Figure 6:
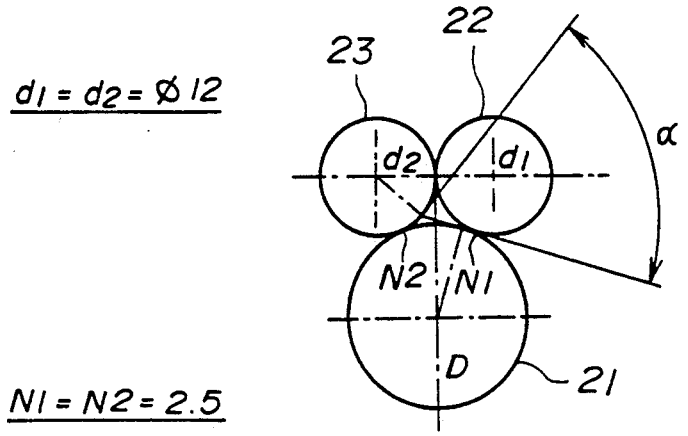
FIG. 6 is a schematic illustration of the fixing roller and the pressing rollers shown in FIG. 3 for explaining a calculation method for determining conditions of a collision angle.

A brief description of the determination of the diameter of the fixing roller 21 and the collision angle will be given with reference to FIG. 6. FIG. 6 is a schematic illustration of the relationship between the fixing roller and the pressing rollers 22, 23. Supposing that the diameters $d_1$ and $d_2$ of the pressing rollers 22 and 23 are equal, and the width of the nips $N_1$ and $N_2$ are also equal, condition where the diameter of the fixing roller 21 is minimized is obtained with $d_1=d_2=12$ mm and $N_1=N_2=2.5$ mm. The following results were obtained, with the conditions mentioned above, by a simulation method using geometrical calculations.

| Dia. of Fixing Roller (mm) | Collision Angle α (degrees) |
|---|---|
| . | . |
| . | . |
| 30 | 57.2 |
| . | . |
| . | . |
| 20 | 65.1 |
| 19 | 66.1 |
| 18 | 67.1 |
| 17 | 68.2 |
| 16 | 69.3 |

As is apparent from the calculation results shown above, a fixing roller of of diameter more than 18 mm is required to satisfy the condition for the collision angle $\alpha < 67^6$.

Generally, a lower pressing force is preferable for the pressing rollers so as to prevent forming of wrinkles, however, in order to maintain a sufficient width of the nip, an elastic layer having a low elastic modulus has been provided in recent fixing apparatus of conventional technology. In the present invention, as shown in FIG. 3, the roller bases 22*a*,23*a* of the pressing rollers 22, 23 are respectively jacketed with an elastic layer 22*b*,23*c* made of silicon rubber foam. The elastic layers 22*b*, 23*b* are further covered with a tube 22*c*,23*c* made of 4-fluoroethylene-perphloroalkoxyethylene, which has a good heat resistance and non-adhesion characteristics with respect to toner and to printing materials.

In spite of a pressing force lower than that used in the conventional fixing apparatus, the nip width of the present invention can be large enough due to the low elastic modulus of the foamed silicon rubber.

Additionally, a distribution of a pressing force along a direction of the width of the nip can be uniform. Accordingly, forming of wrinkles can be prevented. Therefore, a fixing apparatus is realized that can obtain a better quality of a picture formed on various layered materials, compared to the quality of the conventional fixing apparatus employing a solid silicon rubber as an elastic layer.

The present invention is not limited to the specifically disclosed embodiments, and variations may be made without departing from the scope of the present invention.

What is claimed is:

1. A fixing apparatus for an electrographic recorder comprising:

a fixing roller equipped with a heater for fixing a toner transferred onto a material for printing; and a plurality of pressing rollers, spaced a predetermined distance apart from each other along the outer surface of said fixing roller, each of said pressing rollers being pressed to said fixing roller so as to form a nip portion, said material for printing being caught in said nip portion so that said toner is fixed onto said material, said fixing roller and said plurality of pressing rollers being arranged so that an angle formed between a first tangential line tangential to said fixing roller at an outlet point of a nip portion of an upstream pressing roller and a second tangential line tangential to a downstream pressing roller at a point where said first tangential line intersects with a surface of said downstream pressing roller along a conveyance line of said material is less than 67 degrees.

2. A fixing apparatus as claimed in claim 1, wherein a width of each of said nip portions formed by said plurality of pressing rollers is equal to or less than 2.5 mm.

3. A fixing apparatus as claimed in claim 2, wherein a diameter of each of said plurality of pressing rollers is equal to or more than 12 mm, and a diameter of said fixing roller is equal to or more than 18 mm.

4. A fixing apparatus as claimed in claim 1, wherein each of said plurality of pressing rollers includes a roller base as a center portion, an elastic layer provided on an outer surface of said roller base, and a skin layer covering an outer surface of said elastic layer.

5. A fixing apparatus as claimed in claim 4, wherein said elastic layer of each of said plurality of pressing rollers comprises a sponge like foam material having a heat resistance sufficient to withstand heat from said fixing roller, and having a low elastic modulus so as to form said nip portion with small pressing force.

6. A fixing apparatus as claimed in claim 5, wherein said elastic layer of each of said plurality of pressing rollers is made of foamed silicon rubber.

7. A fixing apparatus as claimed in claim 4, wherein said skin layer of each of said plurality of pressing rollers is made of a fluoroplastic material having heat resistance sufficient to withstand heat from said fixing roller, and having a non-adhesion characteristic relative to said toner and said material for printing.

8. A fixing apparatus as claimed in claim 7, wherein said skin layer of each of said plurality of pressing rollers is made of 4-fluoroethylene-perphloroalkoxyethylene.

9. A fixing apparatus as claimed in claim 1, wherein said pressing rollers are each clad in a material having a low elastic modulus.

* * * * *